US010329911B2

(12) United States Patent
Skidmore et al.

(10) Patent No.: US 10,329,911 B2
(45) Date of Patent: Jun. 25, 2019

(54) MINE SEAL AND METHOD OF CONSTRUCTION FOR HIGH RESISTANCE TO TRANSVERSE LOADS

(71) Applicant: E. Dillon & Company, Swords Creek, VA (US)

(72) Inventors: David A. Skidmore, Bluefield, VA (US); Thomas Harmon Harris, Rosedale, VA (US)

(73) Assignee: E. DILLON & COMPANY, Swords Creek, VA (US)

( * ) Notice: Subject to any disclaimer, the term of this patent is extended or adjusted under 35 U.S.C. 154(b) by 620 days.

(21) Appl. No.: 14/289,058

(22) Filed: May 28, 2014

(65) Prior Publication Data

US 2014/0301787 A1 Oct. 9, 2014

(51) Int. Cl.
*E21F 17/103* (2006.01)

(52) U.S. Cl.
CPC ..... *E21F 17/103* (2013.01)

(58) Field of Classification Search
USPC ..... 52/284, 592.1, 591.1, 561; D25/113
See application file for complete search history.

(56) References Cited

U.S. PATENT DOCUMENTS 107,352 A * 9/1870 Fitzgibbons ..... E01C 5/06 404/39
D30,707 S * 5/1899 Paquette ..... D25/113
904,588 A * 11/1908 Wightman ..... 52/426
932,261 A * 8/1909 Flynn ..... E04B 1/161 405/132
952,918 A * 3/1910 Mann ..... E04C 1/395 52/603
1,261,924 A * 4/1918 Grasty et al. ..... E06B 7/32 160/179
1,431,530 A * 10/1922 Leicester ..... E04B 2/04 52/302.1
1,552,077 A * 9/1925 Palanti ..... E04B 2/18 52/286
1,785,499 A * 12/1930 Sayers ..... E04B 2/42 52/437
1,871,618 A * 8/1932 Klopp ..... E06B 1/08 49/404

(Continued)

OTHER PUBLICATIONS

Mathematical definitions from the web, "definitions of rotational symmetry and rectangular prism," uploaded as pdf file. (Year: 2019).*

*Primary Examiner* — Avinash A Savani
*Assistant Examiner* — Martha M Becton

(57) ABSTRACT

A mine seal or wall capable of retaining its integrity under a transverse load. The mine seal is constructed of a plurality of interlocking masonry blocks. The interlocking blocks include a body with a top surface, planar sides, planar ends, and a bottom surface. A top shear lug extends longitudinally along the top of the block. An end shear lug extends vertically along each end of the block. The bottom surface and each end of the block includes a groove therein. When stacked end to end in successive rows, the top and end shear lugs of each interlocking block engage the complimentary grooves in the adjacent blocks thereby enabling the blocks to self-align vertically and lock together as they are stacked. The resulting mine seal exhibits a high resistance to transverse loads.

9 Claims, 8 Drawing Sheets

(56) References Cited

U.S. PATENT DOCUMENTS 1,984,393 A * 12/1934 Brown ..... E04B 2/04 52/284
2,074,813 A * 3/1937 Sill ..... E04B 2/04 52/284
2,173,104 A * 9/1939 Fuller ..... E04B 2/28 52/505
2,210,150 A * 8/1940 Notari ..... E01C 9/004 404/38
2,436,131 A * 2/1948 Werner ..... F27D 1/04 52/591.4
2,472,221 A * 6/1949 Goodall ..... E04C 2/041 52/314
2,693,694 A * 11/1954 Lapidus ..... E04B 2/42 52/503
2,729,064 A * 1/1956 Kennedy ..... E21F 17/103 299/11
2,881,613 A * 4/1959 Taylor ..... E04B 2/10 52/284
2,970,218 A * 1/1961 Shaw ..... G21C 11/028 250/517.1
3,012,377 A * 12/1961 Sunukjian ..... E04B 2/06 52/271
3,025,641 A * 3/1962 Ahtiainen ..... B28B 11/12 52/415
3,132,447 A * 5/1964 Hosbein ..... F23M 5/06 110/332
3,305,982 A * 2/1967 Steele ..... E04B 2/18 446/106
3,347,048 A * 10/1967 Brown ..... E02B 3/14 405/16
3,355,849 A * 12/1967 Hancock ..... E04B 2/22 52/396.08
3,394,517 A * 7/1968 Caterina ..... E04B 2/08 52/284
3,534,518 A * 10/1970 Zagray ..... E04B 2/46 52/258
D220,622 S * 5/1971 Passander et al. ..... D25/118
D223,352 S * 4/1972 Clark et al. ..... D25/113
D238,168 S * 12/1975 Ketcham ..... D21/504
D251,204 S * 2/1979 Ceglia ..... D25/113
4,397,128 A * 8/1983 Wolde-Tinsae ..... E04B 2/30 52/293.2
4,473,985 A * 10/1984 Hunt ..... E04B 2/18 52/503
4,516,879 A * 5/1985 Berry ..... E21F 17/103 405/132
4,696,140 A * 9/1987 Marshall ..... E04B 2/20 52/442
4,698,949 A * 10/1987 Dietrich ..... E04B 2/44 52/415
D302,312 S * 7/1989 Apostolopoulos ..... D25/113
4,896,999 A * 1/1990 Ruckstuhl ..... E02D 29/025 405/262
D305,938 S * 2/1990 Risi ..... D25/113
5,167,474 A * 12/1992 Kennedy ..... E21D 11/102 405/132
5,385,504 A * 1/1995 Hussey ..... E21F 17/103 405/275
5,647,185 A * 7/1997 Forlini ..... E04B 2/06 405/284
5,687,531 A * 11/1997 Nelson ..... E04B 2/08 110/338
5,725,327 A * 3/1998 Hussey ..... E21F 17/103 405/132
D403,785 S * 1/1999 Risi ..... D25/113
6,287,054 B1 * 9/2001 Egan ..... E02D 29/0241 405/262
6,422,790 B1 * 7/2002 Damron ..... E21F 1/14 299/12
D467,668 S * 12/2002 Slagnes ..... D25/113
D495,427 S * 8/2004 Germany ..... D25/113
6,854,220 B2 * 2/2005 Dueck ..... E02D 29/025 405/286
D516,734 S * 3/2006 Keys ..... D25/113
D517,221 S * 3/2006 Keys ..... D25/113
D538,947 S * 3/2007 Price ..... D25/113
D585,566 S * 1/2009 Stenekes ..... D25/113
7,503,729 B2 * 3/2009 Hammer ..... E02D 29/0225 405/284
D598,572 S * 8/2009 Stephansky ..... D25/113
8,141,315 B1 * 3/2012 Shillingburg ..... E02D 29/025 405/286
8,201,376 B2 * 6/2012 Witcher ..... E04C 1/395 52/565
8,281,530 B2 * 10/2012 Chaussee ..... E04F 13/0803 52/290
8,342,776 B2 * 1/2013 Watson ..... E21F 17/103 299/12
8,549,808 B2 * 10/2013 Badin ..... B28B 1/08 52/309.12
8,777,522 B2 * 7/2014 Watson ..... E21F 17/103 299/11
8,863,476 B2 * 10/2014 Summers ..... E04B 2/02 52/585.1
8,882,398 B2 * 11/2014 Bender ..... E02D 29/025 405/284
9,410,313 B1 * 8/2016 Summers ..... E04B 2/02
9,447,685 B2 * 9/2016 Kennedy ..... E21F 1/14
2002/0021042 A1 * 2/2002 Damron ..... E21F 1/14 299/12
2005/0115185 A1 * 6/2005 Telford ..... E04B 2/16 52/596
2005/0204663 A1 * 9/2005 Ferguson ..... E04B 2/52 52/270
2006/0179780 A1 * 8/2006 Price ..... B28B 17/0018 52/604
2006/0283128 A1 * 12/2006 Price ..... E02D 29/025 52/604
2007/0199273 A1 * 8/2007 Wang ..... E04B 2/08 52/604
2009/0205281 A1 * 8/2009 Chaussee ..... E04F 13/0803 52/561

* cited by examiner

MINE SEAL AND METHOD OF CONSTRUCTION FOR HIGH RESISTANCE TO TRANSVERSE LOADS

This application is a continuation-in-part of U.S. patent application Ser. No. 14/108,892 filed Dec. 17, 2013 still pending, and is a continuation-in-part of U.S. patent application Ser. No. 12/584,429 filed Sep. 5, 2009, which application is still pending,

FIELD OF THE INVENTION

The present invention relates to devices for controlling the flow of air in mines or devices for sealing off passageways in mines and particularly to a mine ventilation wall or mine seal formed with a plurality of interlocking masonry blocks for high resistance to transverse loads.

BACKGROUND OF THE INVENTION

Walls are typically formed in mine tunnels for either controlling the flow of air through the mine or for sealing off abandoned sections of the mine. Mine ventilation walls, also known as brattice walls, are frequently constructed in mines to restrict the flow of air to certain passageways in order to maintain a flow of air to the mine face and all portions of the mine that are actively used by mine personnel. Mine seals or stoppings are typically constructed to seal off mined-out areas or abandoned portions of mines.

Previously, materials used to construct mine seals typically included conventional concrete blocks or prefabricated blocks or panels formed of foam or composites. However, the Sago mine disaster, which involved the failure of a mine seal formed of a dense foam product, proved the futility of constructing mine seals with foam. In that instance, an explosion occurred in a mined-out area that had been sealed only a short time before the disaster. Although mine seals may be constructed of conventional concrete blocks, conventional concrete blocks do not provide the shear strength necessary to withstand high transverse loads or shear forces, such as would be experienced in an explosion.

Accordingly, what is needed is a mine seal or stopping structure that is capable of being rapidly constructed while at the same time is capable of withstanding large transverse loads.

SUMMARY OF THE INVENTION

According to the present invention, there is provided a mine seal or wall capable of retaining its integrity under a transverse load without the use of rebar or similar reinforcement materials. The mine seal is constructed of a plurality of interlocking masonry blocks. The interlocking blocks include a body with a top surface, planar sides, planar ends, and a bottom surface. A top shear lug extends longitudinally along the top of the block. An end shear lug extends vertically along each end of the block. The bottom surface and ends of the block include grooves therein for accommodating the shear lugs of adjacently stacked blocks. The blocks are dry-stacked in successive rows to construct a mine wall. When stacked end to end in successive rows, the top and end shear lugs of each interlocking block engage complimentary grooves in the adjacent blocks thereby enabling the blocks to self-align vertically and lock together as they are stacked. The resulting mine seal exhibits a high resistance to transverse loads.

OBJECTS AND ADVANTAGES

Several advantages are achieved with the mine seal of the present invention, including:

a. The mine seal structure exhibits a high resistance to transverse loads. The shear strength of a mine seal constructed according to the present invention averages 1600 lbs/ft higher than the shear strength of a mine seal constructed of conventional solid concrete blocks.

b. Shear lugs on the individual blocks interlock with complimentary grooves in adjacent blocks to substantially increase the shear strength of the mine wall.

c. The shear lugs and complimentary grooves enable rapid alignment of a plurality of interlocking blocks to form a mine wall or seal.

d. The blocks include a self-alignment feature that results in straighter, tighter walls than those constructed of conventional blocks.

e. Blocks are easier to lay or stack than conventional blocks.

f. As only one embodiment of block is required to form a complete mine wall or seal, unit production costs of the block are minimized.

g. As only one embodiment of block is required to form a complete mine wall or seal, the task of transporting the materials required to construct an explosion resistant mine wall is greatly simplified.

h. The block and dry-stacking method of the present invention enables construction of a high shear strength mine seal with a single wall of blocks. Installation time is substantially faster than prior art seals that require pairs or higher numbers of walls.

i. The mine seal of the present invention is explosion-resistant.

j. Interlocking shear lugs and complimentary notches on the blocks result in a mine seal with less leakage than conventional mine seals and more coal mineable per CFM (ventilation flow) and vent setup.

k. The mine seal structure exhibits increased resistance to failure from roof crush, equipment damage, or air pressure differential.

These and other objects and advantages of the present invention will be better understood by reading the following description along with reference to the drawings.

DETAILED DESCRIPTION

Figure 1:
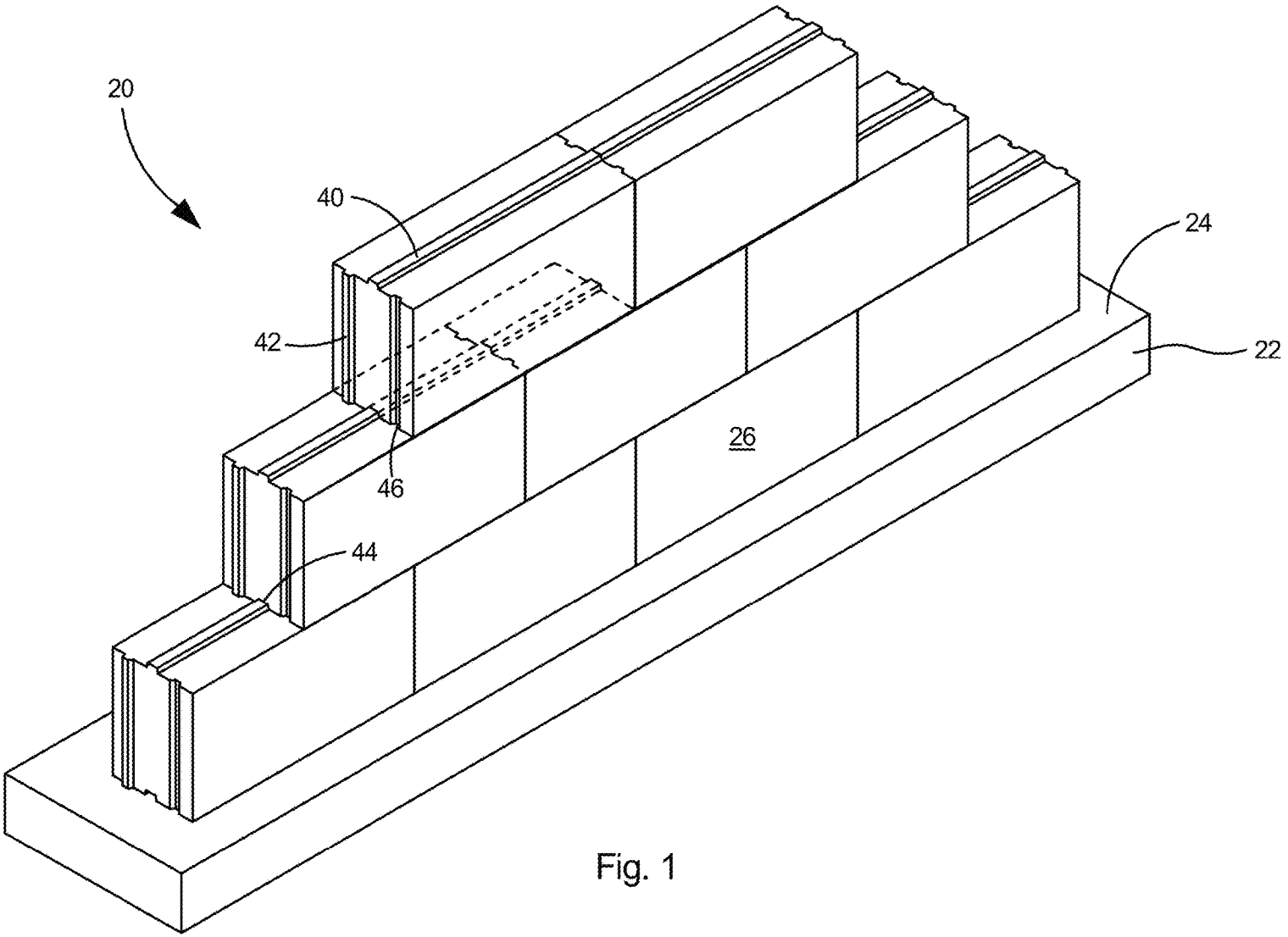
FIG. 1 is a perspective view of partially constructed mine wall according to the present invention.

Referring to FIG. 1 there is shown a portion of a preferred embodiment of a mine wall or seal 20 according to the present invention. The mine seal 20 includes a base 22 with a level top surface 24 and a plurality of interlocking concrete blocks 26 erected on the level surface. The blocks 26 are preferably dry-stacked in successive layers on the level surface 24. The blocks include a rapid alignment mechanism for enabling an installer to align the blocks in each successive row with the row of blocks immediately below it.

Figure 2:
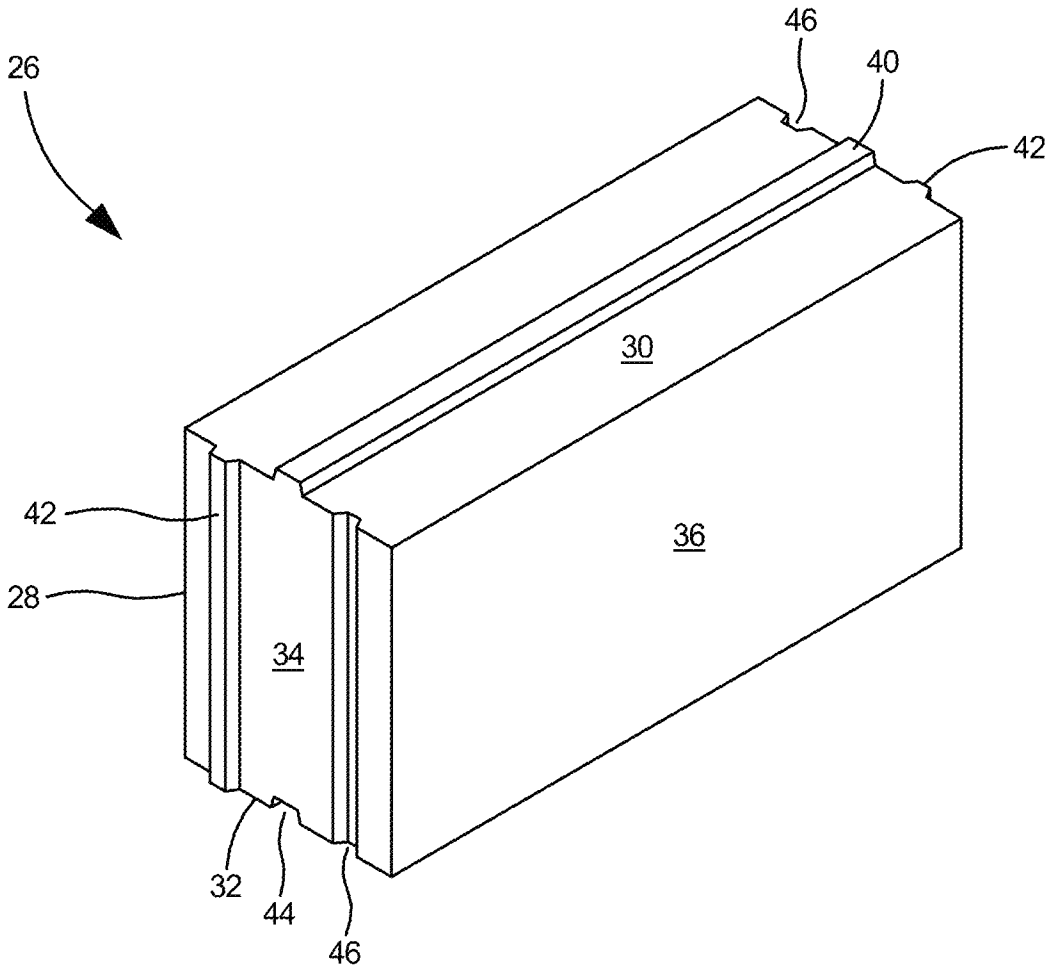
FIG. 2 is a top isometric view of a preferred embodiment of a masonry block used to form the mine wall of FIG. 1.
Figure 5:
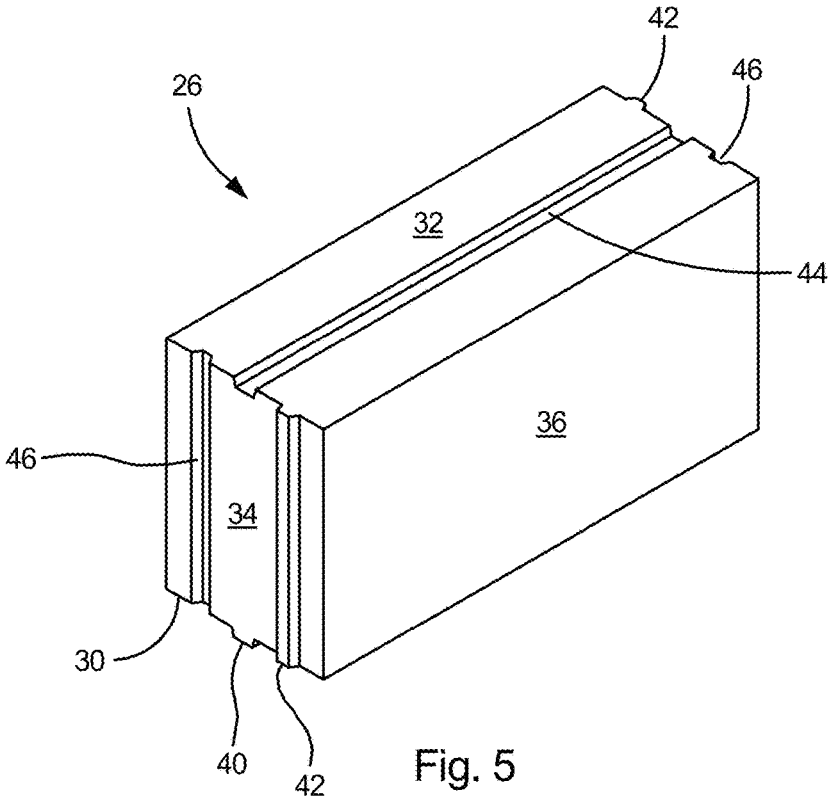
FIG. 5 is a bottom isometric view of the block of FIG. 2.

Referring to FIG. 2, there is shown a preferred embodiment of an interlocking masonry block 26 according to the present invention for use in constructing the mine seal of FIG. 1. The interlocking block 26 includes a solid body 28 with a top surface 30, bottom surface 32, end surfaces 34, and side surfaces 36. The top, bottom, end, and side surfaces 30, 32, 34, and 36 are each substantially planar. A top shear lug 40 extends longitudinally along the top surface 30 and an end shear lug 42 extends vertically along each end 34 of the block. As shown in FIG. 5, a bottom groove 44 extends longitudinally along the bottom surface 32 of the block 26 and an end groove 46 extends vertically along each end surface 34.

Figure 3:
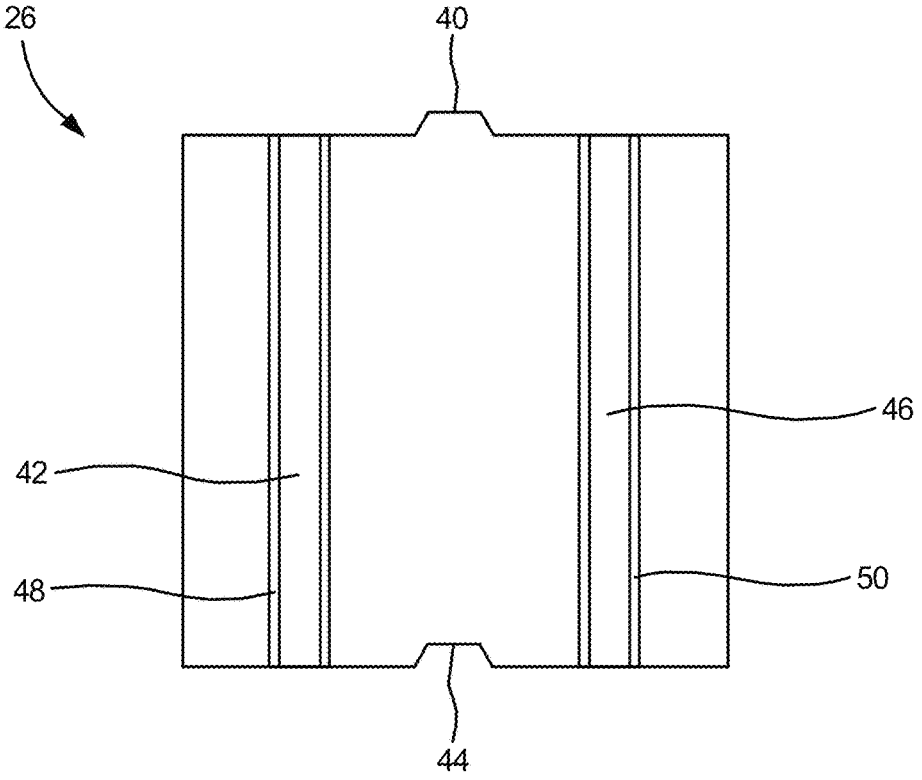
FIG. 3 is an end view of the block of FIG. 2.
Figure 3A:
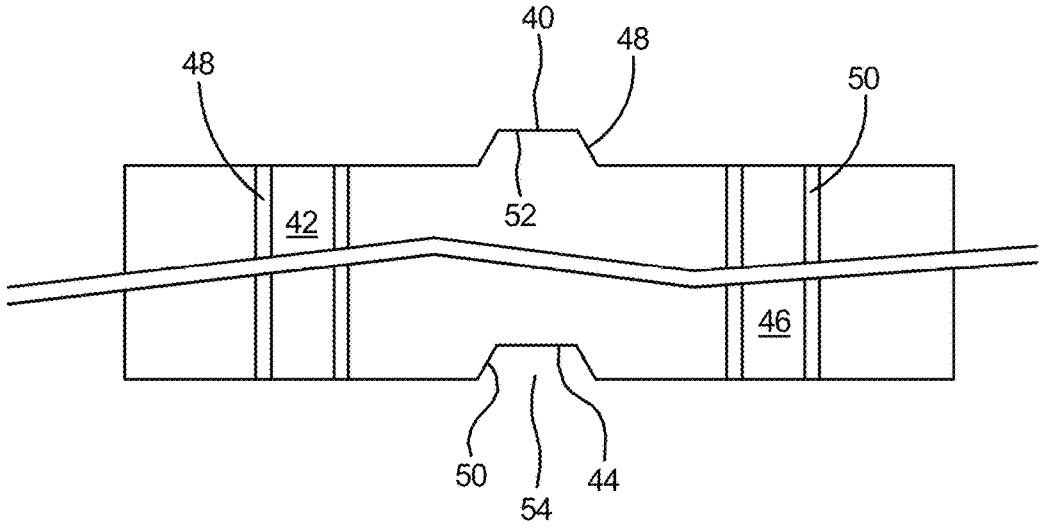
FIG. 3A is a detail view depicting a shear lug and complimentary groove in the block of FIG. 2.
Figure 4:
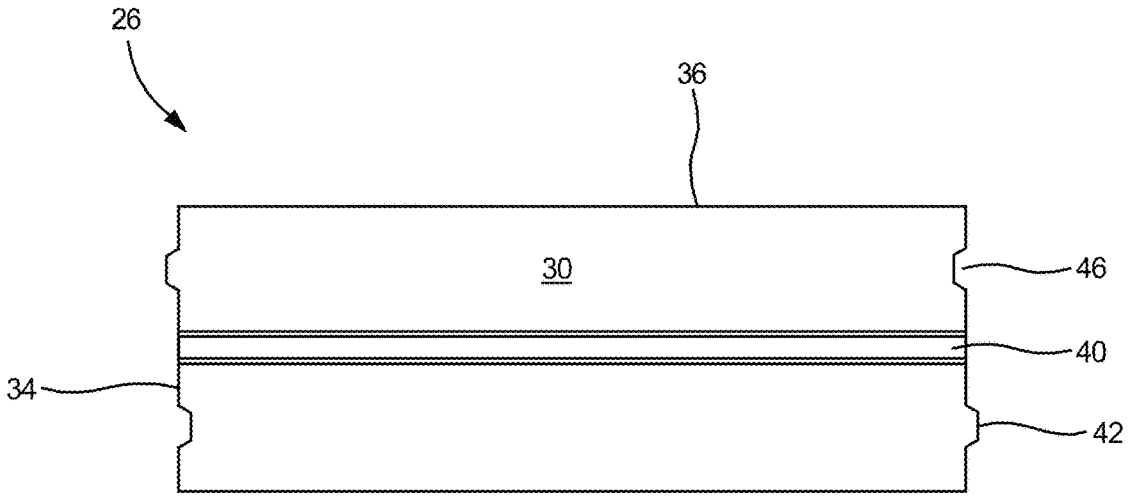
FIG. 4 is a top view of the block.

With reference to FIGS. 3 and 3A, both the top shear lug 40 and end shear lugs 42 preferably include beveled sidewalls 48 and the grooves 44 and 46 preferably included beveled sidewalls 50. The shear lugs and grooves are thus substantially trapezoid-shaped as viewed from their ends. The beveled sides of the shear lugs and grooves, as well as the fact that the farthest outward surface 52 of the shear lugs is smaller than the entry 54 of the grooves, enables rapid end-to-end joining of blocks and rapid dry-stacking of successive rows of blocks as the beveled sidewalls 48 of the shear lugs easily find and fit into the respective grooves.

Referring to FIG. 2, the end shear lugs 42 on each end 34 of the block 26 are on opposite sides of the end, making one end a mirror image of the opposing end. This arrangement gives a distinct advantage when dry-stacking a plurality of blocks as the block need not be rotated 180° on its bottom surface 32 in order to slide it into engagement with an adjacent block in a dry-stacked structure. Thus, an installer can quickly remove blocks from a pallet and stack them into a wall without needing to rotate any individual block into the proper orientation.

Most preferably, a substantially linear trench is dug in the floor of the mine tunnel to accommodate poured concrete for the forming of a base 22 with a level surface 24. Conventional means, such as 2×6-inch boards, can be used to build a form for containing the concrete pour and obtaining the level surface. Furthermore, the concrete base can be formed at a height such that the subsequent rows of blocks will approximately top out substantially even with the mine roof. As mine roofs typically settle with time, the newly formed mine seal will eventually be held in place by overhead pressure.

Figure 7:
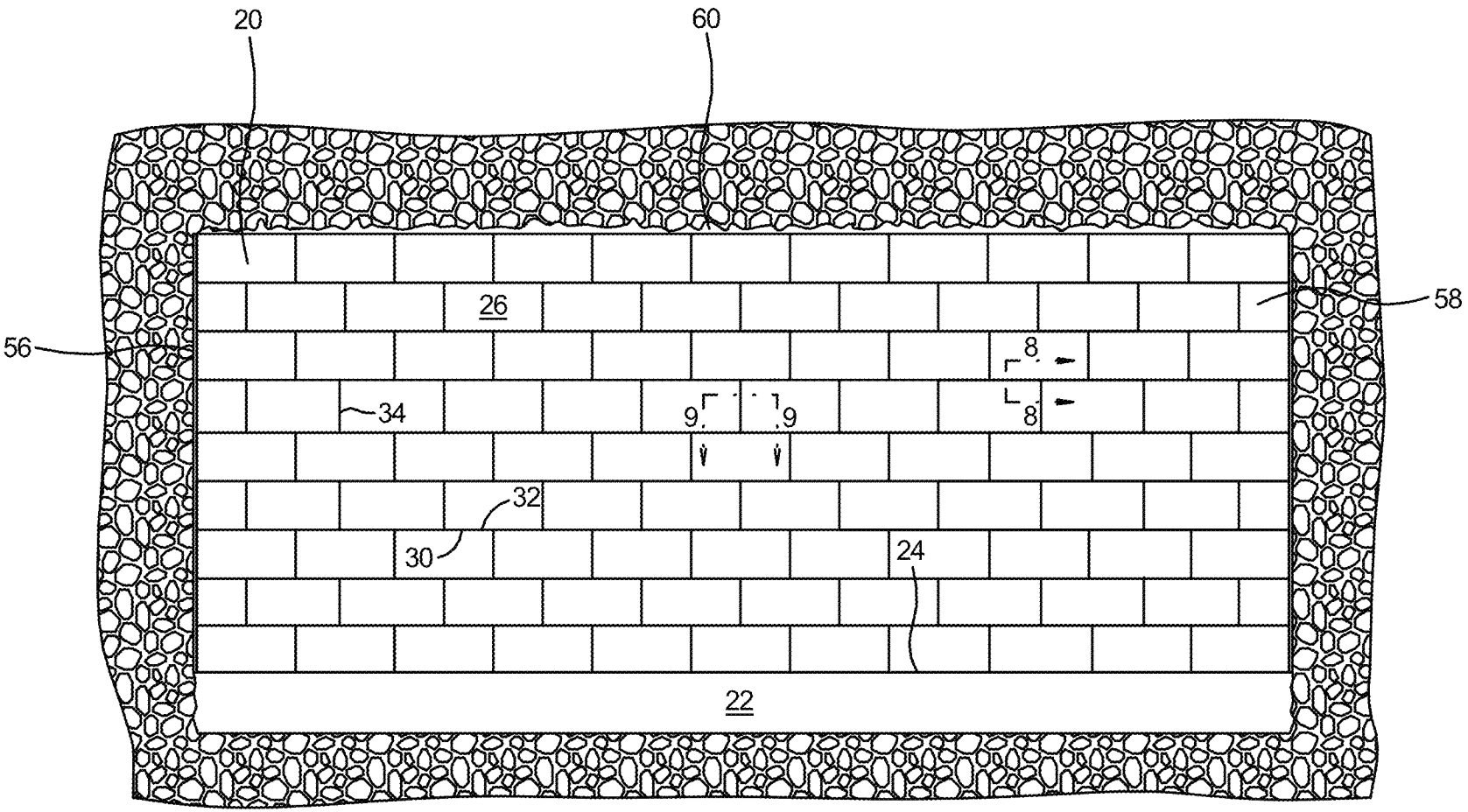
FIG. 7 is a front elevation view of the preferred embodiment of a mine seal within a mine entrance constructed with a plurality of masonry blocks according to the present invention.
Figure 9:
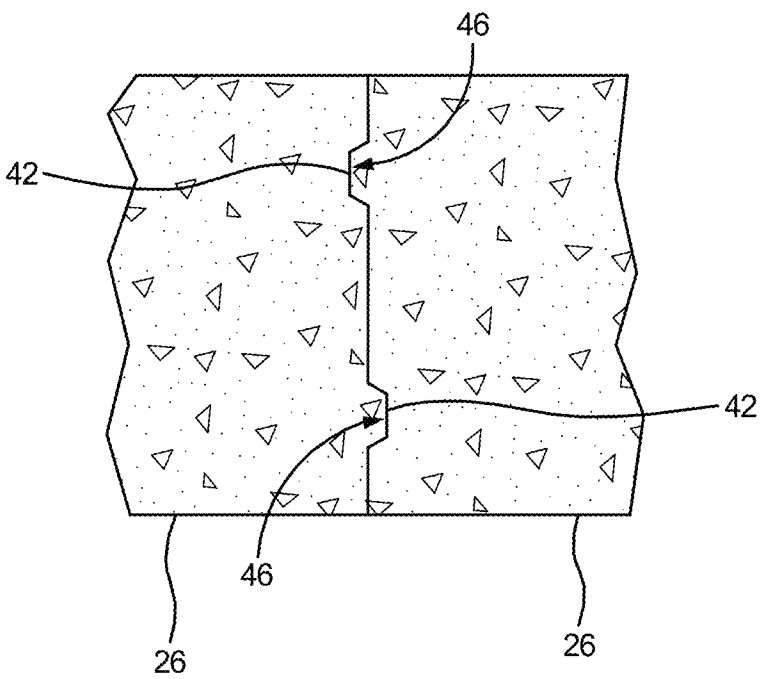
FIG. 9 is a sectional view of a portion of the mine seal of FIG. 7 taken along line 9-9 of FIG. 7.
Figure 8:
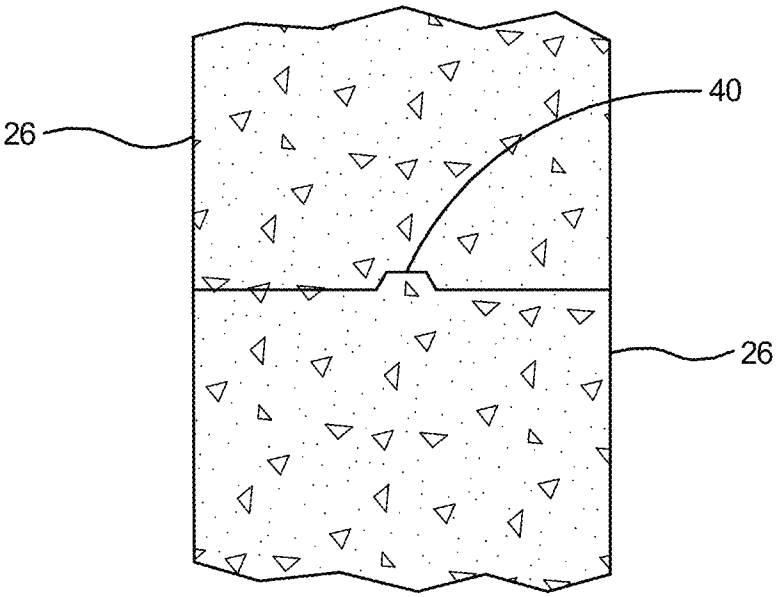
FIG. 8 is a sectional view of a portion of the mine seal of FIG. 7 taken along line 8-8 of FIG. 7.

With reference to FIG. 7, a plurality of blocks 26 according to the invention are dry-stacked on level surface 24 of base 22 to form a mine seal 20 within a mine entrance or tunnel 56. In a mine seal 20 according to the present invention, half-length blocks 58 may be used if desired or strictly full-length blocks 26 to block the mine entrance 56. The level surface 24 of base 24 maintains each succeeding row of blocks level and horizontally aligned with the row or rows below it. Most preferably, sealing materials 60 such as wood planks, foam, or similar materials can be used to seal any air spaces between the seal 20 and the tunnel roof or walls. Preferably, any air spaces may be filled with a coating of MSHA-certified sealant, such as Silent Seal available from Fomo Products, Inc. of Norton, Ohio. Furthermore, the exposed surfaces of either wall may be coated with a conventional MSHA flame retardant sealant layer.

As the ends of the blocks 26 of the present invention are minor-images of each other, any block can be swapped end-to-end without regard to fitting into the mine seal structure as each subsequent row of blocks is dry-stacked. The beveled sides of the shear lugs 40 and 42 and grooves 44 and 46, as well as the fact that the farthest outward surface 52 of the shear lugs is smaller than the entry 54 of the grooves (see FIG. 3A), enables rapid end-to-end joining of blocks and rapid dry-stacking of successive rows of blocks as the beveled sidewalls 48 of the shear lugs 40 and 42 easily find and fit into the respective grooves 42 and 44. As shown in FIG. 7, the dry-stacked blocks 26 are slid together end-to-end, with the end surfaces 34 of each adjacent block flush with each other and the bottom surface 32 of any block in an upper row flush with the top surfaces 30 of any adjacent row of blocks below it. Furthermore, the shear lugs 40 on the top of each block 26 and the shear lugs 42 on the ends 34 of each block interlock with their respective grooves 44 and 46 thereby provide a substantial increase in resistance to a shear force or sideways pressure P (see FIG. 6) against either face 62 of the mine seal 20.

Figure 6:
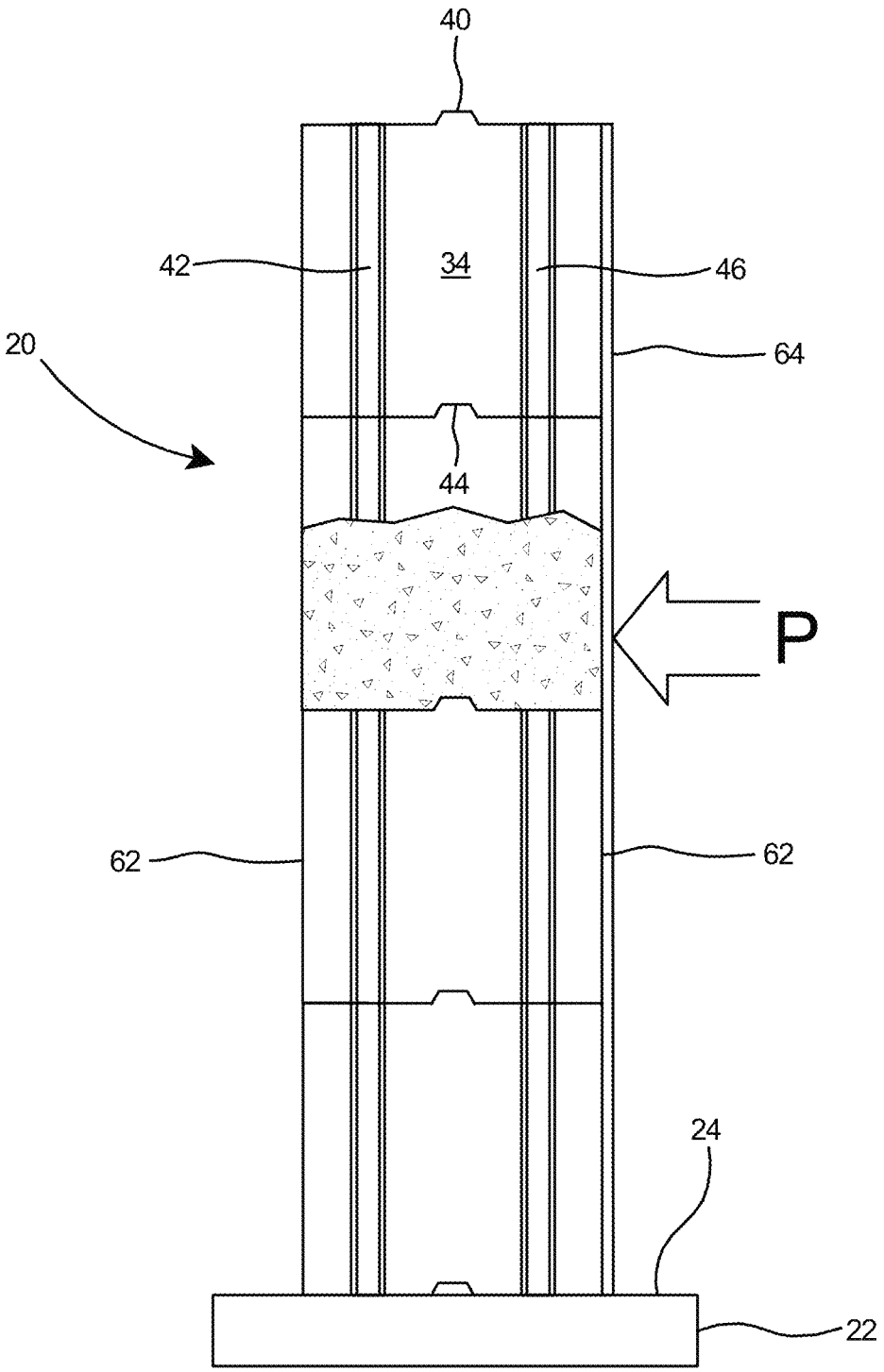
FIG. 6 is an end view of a portion of the mine wall of FIG. 1.

With reference to FIG. 6, the interlocking shear lugs between all upper and lower surfaces of adjacent blocks and between all end surfaces of adjacent blocks form an effective mine seal that is substantially impervious to air penetration, which property is beneficial when a mine wall is erected as a ventilation wall. When a mine wall is erected to serve as a mine seal 20, the interlocking shear lugs 40 and 42 enable the wall to resist a substantial a displacement force or shear force P (see FIG. 6). The high shear strength is achieved without the use of reinforcement rods or masonry anchors.

Mine seals are constructed to seal off mined-out portions of a mine from the active mine. It is critical that such mine seals exhibit high shear strength or a strong resistance to a transverse load. A transverse load is defined as deflection from pressure exerted on one side of the seal.

Figure 10:
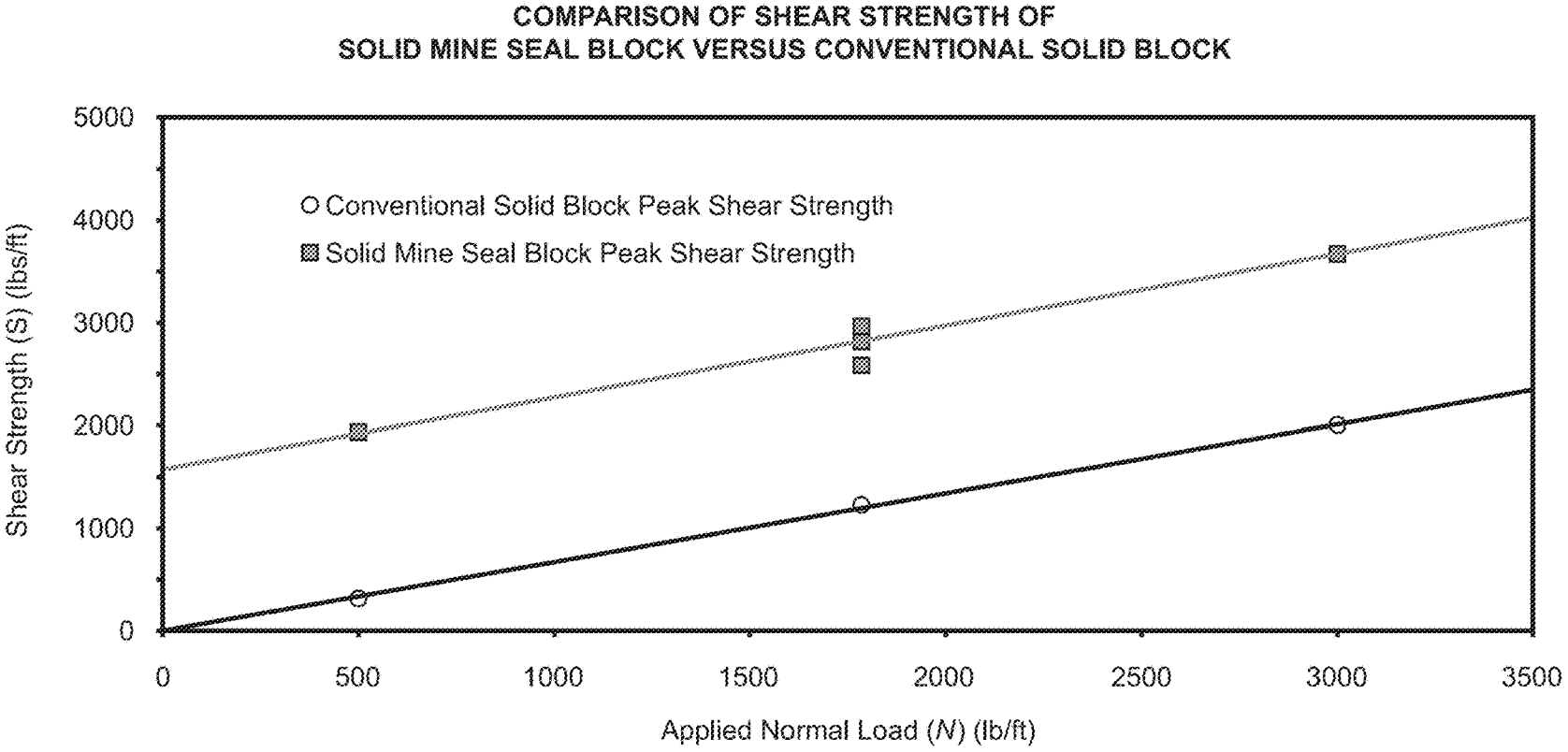
FIG. 10 is a graph depicting a comparison of shear strengths of a mine seal constructed of conventional solid masonry blocks versus a mine seal constructed of the preferred embodiment of block according to the present invention.

For testing purposes, several mine seals were constructed with 1) conventional solid concrete blocks (control condition), and several with 2) mine seal blocks according the present invention (test condition) (see FIG. 2). Resistance to transverse loads varies with the normal load applied at the top of the mine seal. Both sets of mine seals were tested at normal loads of 500, 1750, and 3000 lbs/ft. As shown in FIG. 10, a mine seal constructed with mine seal blocks according to the present invention recorded substantially higher shear strength at each of the three normal load conditions. The shear strength for both the control and test condition increased substantially linearly with the normal load. A wall constructed with the mine seal block of the present invention recorded on average 1600 lbs/ft higher shear strength at a given applied normal load than a wall constructed of conventional solid concrete blocks. According to the present invention, the mine seal of the present invention can withstand a shear strength of at least 1900 pounds per foot (lbs/ft) under an applied normal load of 500 lbs/ft, a shear strength of at least 2700 pounds per foot (lbs/ft) under an applied normal load of 1750 lbs/ft, and a shear strength of at least 3600 pounds per foot (lbs/ft) under an applied normal load of 3000 lbs/ft.

As shown in FIG. 2 the blocks 26 of the present invention include a self-aligning structure. The single top shear lug 40 and the complimentary longitudinal groove 44 along the bottom surface 32 ensure that, when forming a mine seal, the blocks in each upper row align properly with the blocks there below to form a perfectly aligned vertical wall. Furthermore, when building the wall, it is not necessary for the installer to align the blocks such that the ends of each block in an upper row are staggered with respect to the ends in any of the lower rows of block. As the lugs substantially lock the blocks together at all seams in the constructed wall, there is no necessity to stagger the blocks, which enables an installer to rapidly construct a mine seal.

As the invention has been described, it will be apparent to those skilled in the art that the embodiments shown herein may be varied in many ways without departing from the spirit and scope of the invention. Any and all such modifications are intended to be included within the scope of the appended claims.

What is claimed is:

1. An explosion-resistant mine seal comprising:

a plurality of masonry blocks dry-stacked and interlocked to form a wall;

said masonry blocks including a solid body having two ends, a top surface, a bottom surface forming a generally rectangle prism shape, a top shear lug extending longitudinally along said top surface, and end shear lugs extending vertically along each of said ends of said masonry block;

an end groove extending vertically along each end surface of said masonry block and parallel to each end shear lug;

a bottom groove extending longitudinally along said bottom surface of said block;

said top shear lug including a beveled sidewall and a flat outer surface;

said bottom groove and said end grooves including a beveled sidewall and an entry;

said top shear lug decreasing in width from said top surface of said block to said outer surface;

said bottom groove increasing in width from said bottom surface of said block to said entry;

said top shear lug is centered on said top surface of said masonry block and said bottom groove is centered on said bottom surface of said block;

the end shear lugs and grooves arranged on the ends of said masonry block such that, when looking down at the top surface, the block has a rotational symmetry when rotated 180 degrees and wherein when stacked end to end in successive rows, the top and end shear lugs of each interlocking block engage complimentary bottom and end grooves in the adjacent blocks thereby enabling the blocks to self-align vertically and lock together as they are stacked.

2. The explosion-resistant mine seal of claim 1 including a base with a level surface, said masonry blocks stacked on said level surface of said base.

3. The explosion-resistant mine seal of claim 1 wherein said wall includes a front and rear vertical face.

4. The explosion-resistant mine seal of claim 1 wherein said end shear lugs on each end of said masonry block are on opposite sides of each end of the block.

5. The explosion-resistant mine seal of claim 1 wherein said ends of said blocks are mirror-images of each other.

6. A method of constructing an explosion-resistant mine seal across a mine entry including the steps of:

installing a base with a level top surface spanning the mine entry;

providing a plurality of blocks, each of said blocks including a top surface, a bottom surface, two end surfaces at 90 degrees to said top surface and said bottom surface forming a generally rectangular prism shape, a top shear lug extending longitudinally along said top surface, said top shear lug including a beveled sidewall and a farthest outer surface, a bottom groove extending longitudinally along said bottom surface of said block, end shear lugs extending vertically along each of said ends of said masonry block, and an end groove extending vertically along each end surface of said masonry block parallel to each end shear lug, said bottom groove and said end grooves including a beveled sidewall and an entry, said top shear lug decreasing in width from said top surface of said block to said farthest outer surface, said bottom groove increasing in width from said bottom surface of said block to said entry said shear lugs and grooves are trapezoid-shaped as viewed from their ends, and said top shear lug is centered on said top surface of each masonry block and said bottom groove is centered on said bottom surface of each block;

the end shear lugs and grooves arranged on the ends of said masonry blocks such that, when looking down at the top surface, each block has a rotational symmetry when rotated 180 degrees and wherein when stacked end to end in successive rows, the top and end shear lugs of each interlocking block engage complimentary bottom and end grooves in the adjacent blocks thereby enabling the blocks to self-align vertically and lock together as they are stacked;

dry-stacking and interlocking the blocks on the level top surface of the base across the width of the mine entry to form a first row of blocks;

stacking and interlocking additional rows of blocks on said first row of blocks until the blocks substantially reach the roof of the mine entry and form a block wall across the mine entry.

7. The method of claim 6 further comprising applying a sealant to air spaces between the periphery of the block wall and the mine entry.

8. The method of claim 6 further comprising applying a fire-resistant sealant layer to one or more sides of said mine seal.

9. A masonry block for forming an explosion-resistant mine seal consisting of:

a solid body having two ends, a top surface, and a bottom surface, said ends at 90 degrees to said top surface and said bottom surface forming a generally rectangular prism shape;

a top shear lug extending longitudinally along said top surface of said block;

an end shear lug extending vertically along each of said ends of said masonry block;

said shear lugs and grooves are trapezoid-shaped as viewed from their ends;

said end shear lugs on each end of said block are on opposite sides of said ends;

an end groove extending vertically along each end surface of said masonry block, said end groove offset from and parallel to each said end shear lug;

a bottom groove extending longitudinally along said bottom surface of said block;

said end shear lug on each end of said block are on opposite sides of said ends;

said top shear lug including a beveled sidewall and a farthest outer surface;

said bottom groove and said end grooves including a beveled sidewall and an entry;

said top shear lug decreasing in width from said top surface of said block to said farthest outer surface; and said bottom groove increasing in width from said bottom surface of said block to said entry;

said top shear lug is centered on said top surface of said masonry block and said bottom groove is centered on said bottom surface of said block;

the end shear lugs and grooves arranged on the ends of said masonry block such that, when looking down at the top surface, the block has a rotational symmetry when rotated 180 degrees; and the top and end shear lugs of said block are configured such that they engage complimentary bottom and end grooves in adjacent self-similar blocks thereby enabling consecutive blocks to self-align vertically and lock together when stacked.

* * * * *